US005184558A

United States Patent [19]

Wozniacki

[11] Patent Number: 5,184,558

[45] Date of Patent: Feb. 9, 1993

[54] PALLET AND METHOD AND APPARATUS FOR MAKING SAME

[75] Inventor: Roger M. Wozniacki, Cumming, Ga.

[73] Assignee: Gaylord Container Corporation, Deerfield, Ill.

[21] Appl. No.: 799,042

[22] Filed: Nov. 27, 1991

[51] Int. Cl.[5] ..... B65D 19/00

[52] U.S. Cl. ..... 108/51.3; 108/52.1; 493/964; 493/405; 493/356; 493/355

[58] Field of Search ..... 108/51.1, 51.3, 52.1, 108/56.1; 493/DIG. 964, 405, 355, 356

[56] References Cited

U.S. PATENT DOCUMENTS 4,841,879 6/1989 Ferguson ..... 108/51.1

4,979,446 12/1990 Winebarger ..... 108/51.3

*Primary Examiner*—Kenneth J. Dorner

*Assistant Examiner*—Gerald A. Anderson

*Attorney, Agent, or Firm*—Hopkins & Thomas

[57] ABSTRACT

A pallet of lightweight corrugated paperboard includes spaced longitudinally extending members intersecting spaced laterally extending members by means of interengaging notches in alignment with the cross-members. Either of the longitudinally extending members and laterally extending members may have cutouts forming channels for receiving points for the tines of pallet lifting equipment. The lifting points for the tines are entirely unbroken horizontally extending panels with added support panels increasing the width of the lifting point. Each member is scored on only one side, and symmetrically folded inward to form a solid core of corrugated paperboard panels.

13 Claims, 4 Drawing Sheets 12
21
32
30
31
15
24
25
28
29
26
14
27
38
42
37
41
36
40
35

50

PALLET AND METHOD AND APPARATUS FOR MAKING SAME

BACKGROUND OF THE INVENTION

1. Field of the Invention

The present invention relates to pallets of the type which support goods thereon for storage and shipping. The present invention also relates to a method and apparatus for making cross-members from recyclable corrugated paper board and assembling these members into a pallet with the strength of wood.

2. Description of the Prior Art

Pallets for many years have been made completely of wood primarily due to the strength of wood and the possible reusability of wooden pallets. However, wooden pallets are heavy and expensive and are not easily disposed of after they are damaged beyond repair or cannot be reused because of size or design. The critical shortage of landfill space in the most populous states has resulted in the refusal to accept unwanted wooden pallets. An additional hazard with wooden pallets is the nails used in their construction. As damage occurs to the pallet, protruding and/or exposed nail points and heads can cause damage to goods placed thereon as well as injury to those persons handling the pallets. It is estimated that the grocery trade alone loses 2 billion dollars per year from damage to wooden pallets, purchasing and return costs, repairs, storage, landfill costs, product damage, etc. Other problems include pallet and product contamination, product spillage, insect infestation of the wood and the need for Class A or new pallets for certain goods, i.e. foodstuffs, due to FDA regulations. These problems, the decreasing supply of readily available slow growing hard wood, and the related increasing cost of lumber have led to the development of pallets made from other light-weight, relatively inexpensive material, such as corrugated paperboard from fast growing soft wood trees. Where only 9 wooden pallets can be made from a single tree, the same tree can be used to produce 25–33 corrugated pallets. Two such types of corrugated pallets are illustrated by structures shown in U.S. Pat. Nos. 4,936,229 and 4,378,743.

Pallets made from corrugated paperboard are lighter in weight than pallets made from wood, are easily disposed of, and are eventually recyclable into boxes or additional pallets. Prior art corrugated pallets have been limited in the loads they can carry, however, primarily due to limited beam strength and certain inherent weaknesses in construction. Such pallets may be stored fully loaded in a rack system, stored without any support while loaded, or be lifted in cantilever fashion on short forks of a fork lift, thus, beam strength is critical.

One type of design known in the art for corrugated paperboard pallets with greater strength characteristics is a grid structure. However, to maintain the cost effectiveness of corrugated paperboard pallets in heavy load applications, the design of the pallets has to be uncomplicated enough to allow for a high speed automated assembly process, which is normally the slowest part of production. An automated process is disclosed in U.S. Pat. No. 4,792,325. In order to provide increased strength in corrugated paperboard pallets and to design the pallets to maintain this increased strength through its life cycle, the runners and stringers have been made with complicated structures requiring expensive machinery to assemble. Such a design for a corrugated paperboard pallet is disclosed in U.S. Pat. No. 4,979,446. The cost of the automation machinery for such designs can be upwards of $500 M and such machinery is limited in production to approximately 100–150 pallets per hour. Thus, while corrugated paperboard pallets have been designed to handle greater loads, their structures have become more complicated, resulting in an increased cost of production.

Even with the relatively recent improvements however, prior art pallets are still of insufficient strength for many applications and inadequate in certain critical areas of the pallets. For example, pallets of the grid-type design have cutouts in cross members for receiving the tines of the forklift. These lifting points which receive the tines are inherently weaker and can be snapped by the forklift tines or broken under load. Therefore, there is a need for a stronger more resilient pallet that avoids the above-mentioned problems, that use less material and are less expensive to manufacture and which require less machinery cost for production and assembly.

SUMMARY OF THE INVENTION

It is, therefore, one of the principal objects of the present invention to provide a corrugated paperboard pallet that is characterized by superior strength in compression, with crush resistance of over 20,000 pounds, and in resistance to lateral loading while using less material more efficiently than prior art designs.

Another object of the present invention is to provide an improved pallet that can be economically produced from 100% recyclable materials and which itself is conveniently and 100% recyclable.

A further object of the present invention is to provide a corrugated paperboard pallet with a very high speed, low cost fabrication method and less expensive apparatus therefor and which provides a unique means for strengthening the critical lifting points which are acted upon by the tines of the fork lifts or the like.

A still further object of the present invention is to provide an extremely stable corrugated pallet which has the critical beam strength necessary for safety and reliability in use with very heavy loads, and which can be produced at a rate of over four times the rate of prior designs, the high speed assembly also having low labor costs.

These and additional objects are attained by the present invention, which relates to a 100% recyclable pallet made entirely of corrugated paperboard and to a method and apparatus for assembling such pallets. The pallet comprises a plurality of spaced, parallel, longitudinally-extending members interconnected with a plurality of spaced, parallel, laterally-extending members. In an alternative embodiment, the pallet includes a flat sheet of corrugated paperboard connected to the top and/or bottom edges of the cross-members, such flat sheets being solid or having holes therein to accommodate the lifting members of certain hand jacks. The present pallets use substantially less material than prior art designs and have no exposed flutes in the critical lifting area. The pallet is highly compatible with normal corrugated efficiencies, in contrast to known prior art designs, and can be made in a highly automated process.

The longitudinally and laterally extending members are interconnected by a series of cutout notches allowing the members to engage one another forming level top and bottom surfaces. Each member is formed from a rectangular blank which has predetermined sections cut out, and is then scored and folded with fastening means applied to at least one of the faces of the individual sections as the folding proceeds for creating a laminated beam. At least one set of cross-members, either the longitudinally extending members or the laterally extending members, or possibly both, include cutouts therein for forming a channel to receive the tines of a forklift or hand jack. Both the longitudinally extending and laterally extending members are formed in a similar manner with the only required difference being that one set of cross members have cutout notches in their top halves while the other set of cross members have cutout notches in their bottom halves.

The members are also formed in a symmetrical manner about the center line of the blank with all the scoring done on one side of the blanks. This simplifies the design of the machinery and allows for a substantially increased rate of production. After scoring, the blanks are folded to form the cross members, which include uniquely reinforced lifting points for increased strength and greater durability, eliminating most flute exposure to keep out moisture and other contaminants and/or foreign matters. Once the members are formed, they are aligned in a spaced parallel relationship to allow for of the interconnection of the cross members. Top and bottom sheets may then be applied to the cross members.

The apparatus for forming the pallets comprises a scoring station, a first folding station, a second folding station, gluing means and a compression station for forming the laminated beams. An alignment and interconnection station, and a top and bottom sheet application station, are also included for assembling the pallet. The design of the pallet allows for a greatly simplified process for forming and assembling the pallets which, in turn, substantially reduces the cost of the machinery and the time required to manufacture the pallets.

DESCRIPTION OF THE PREFERRED EMBODIMENT

Figure 1:
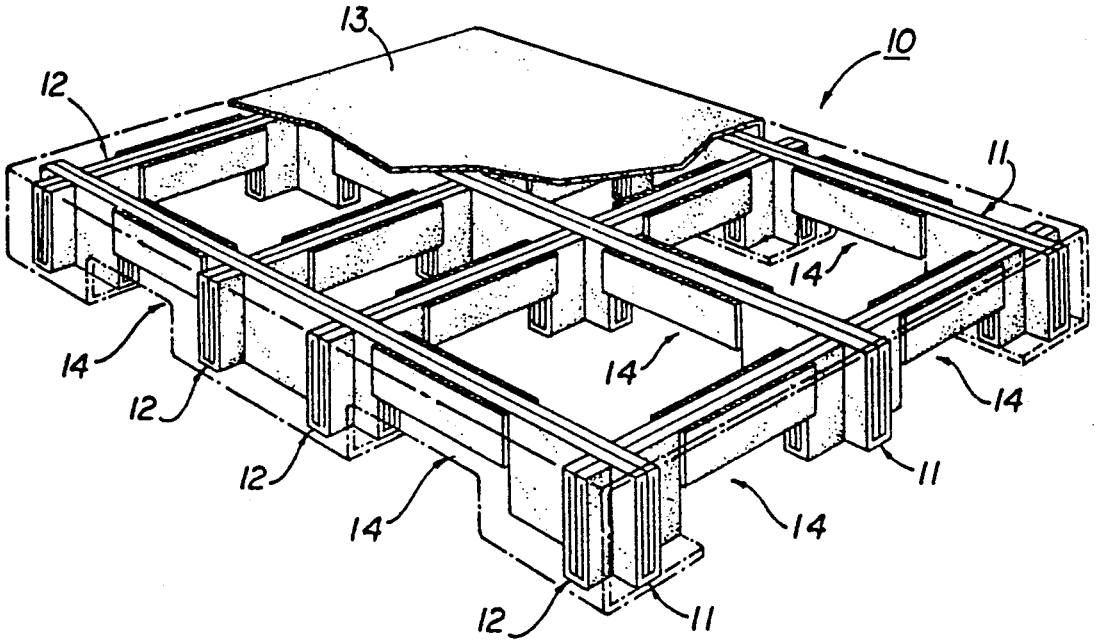
FIG. 1 is a perspective view of the present corrugated pallet in assembled form with a cover sheet shown partially and in phantom lines.

Referring now more specifically to the drawings and to FIG. 1 in particular, numeral 10 designates generally a pallet for supporting a load of goods or the like. The pallet in general comprises a series of spaced parallel longitudinally extending members or stringers 11 interconnected with a series of spaced parallel laterally extending members or stringers 12, thus forming a grid-type structure. As an option, top sheet 13 is adhesively applied to top edges of the longitudinal and lateral members and a bottom sheet 16 may be applied to the bottom edges. The top sheet or cover is normally employed when the pallet or platform is used for supporting a plurality of boxes, kegs, etc., the dimensions of which would require a solid top surface. Where the pallet is used for supporting a container with dimensions equal to the pallet, such as a large box, the top sheet may not be required. Similarly, the bottom sheet would normally be indicated for applications in which the pallet will be transported or moved on a conveyor which utilizes rollers or where the loaded pallets are to be stored in a vertically stacked arrangement. In other applications, the bottom sheet may be optional. The top and bottom sheets also contribute a stabilizing function, in combination with the unique and extremely solid structural cross members.

The height H (FIG. 3) of the longitudinal and lateral members is equal. Thus, when these members are interconnected, their top and bottom surfaces will be in parallel horizontal planes thereby providing an even surface for supporting objects thereon or for applying the top or bottom sheets. As shown in FIG. 1, pallet 10 includes three longitudinal members and four lateral members, however, more or less lateral and longitudinal members may be utilized.

Figure 2:
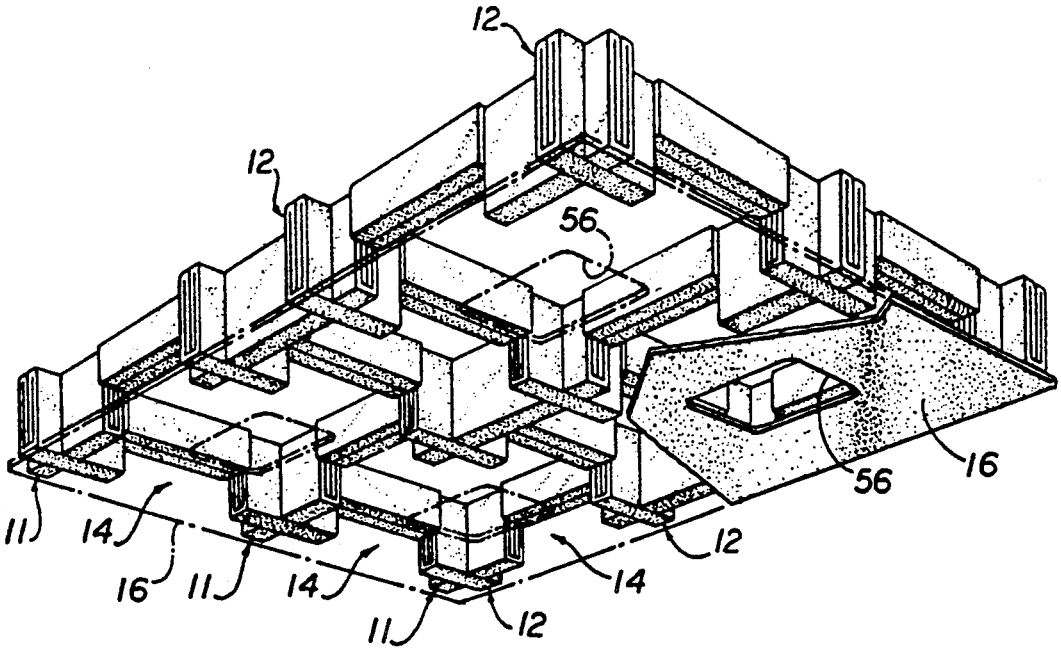
FIG. 2 is a perspective view of the bottom half of the corrugated pallet; illustrating also a partially shown bottom sheet.

Either the longitudinal members or the lateral members, or both, include a pair of cutouts 14 for forming a channel through which the tines of pallet lifting equipment can be inserted. FIGS. 1 and 2 show an embodiment wherein both the longitudinal and lateral members include cutouts 14. This creates either a two-way entry or a four-way entry for the tines of a fork lift or the like. The formation of the channels will be discussed hereinafter.

Figure 3:
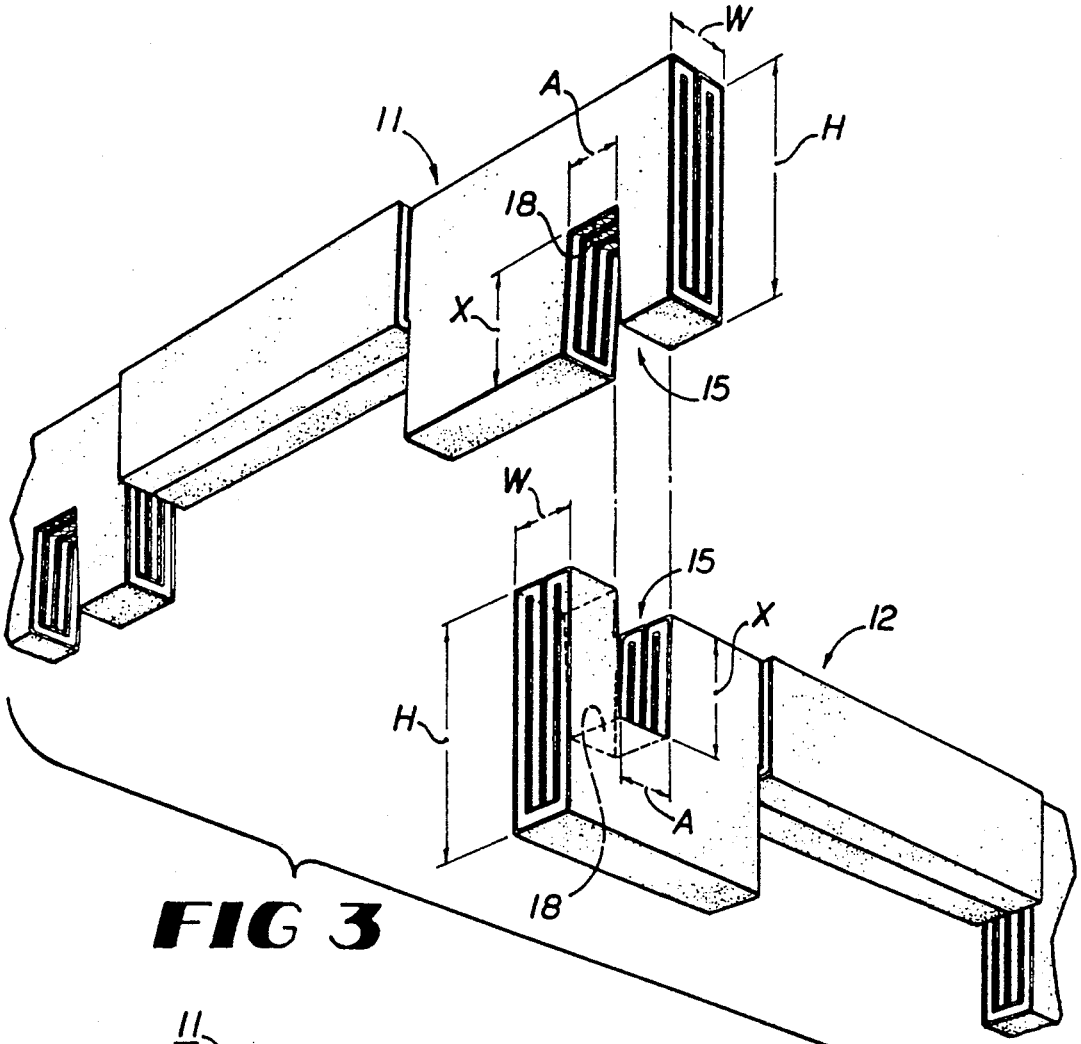
FIG. 3 is a partial, exploded view illustrating how the cross members of the pallet are assembled.

The longitudinal members 11 and lateral members 12 are interconnected by means of aligning and mating the corresponding, but oppositely facing notches 15 which are formed in the longitudinal and lateral members at predetermined locations (FIG. 3). The interlocking engagement of the longitudinal and lateral members forms a friction fit imparting sufficient rigidity to the intersection to maintain a fixed relationship between the interlocking stringers. In order to maintain a fixed relationship within the interconnection, surfaces 18 are substantially square in shape and distance X is one half of distance H. Also, distance A is slightly less than distance W to effect the friction fit necessary to maintain interlocking members 11 and 12 in a fixed relationship during use. FIG. 3 shows the alignment for an interlocking engagement for notches 15 positioned near the ends of each of the longitudinal and lateral members; however, the interlocking design for all notches in the stringers is the same, regardless of their location therein.

Figure 4:
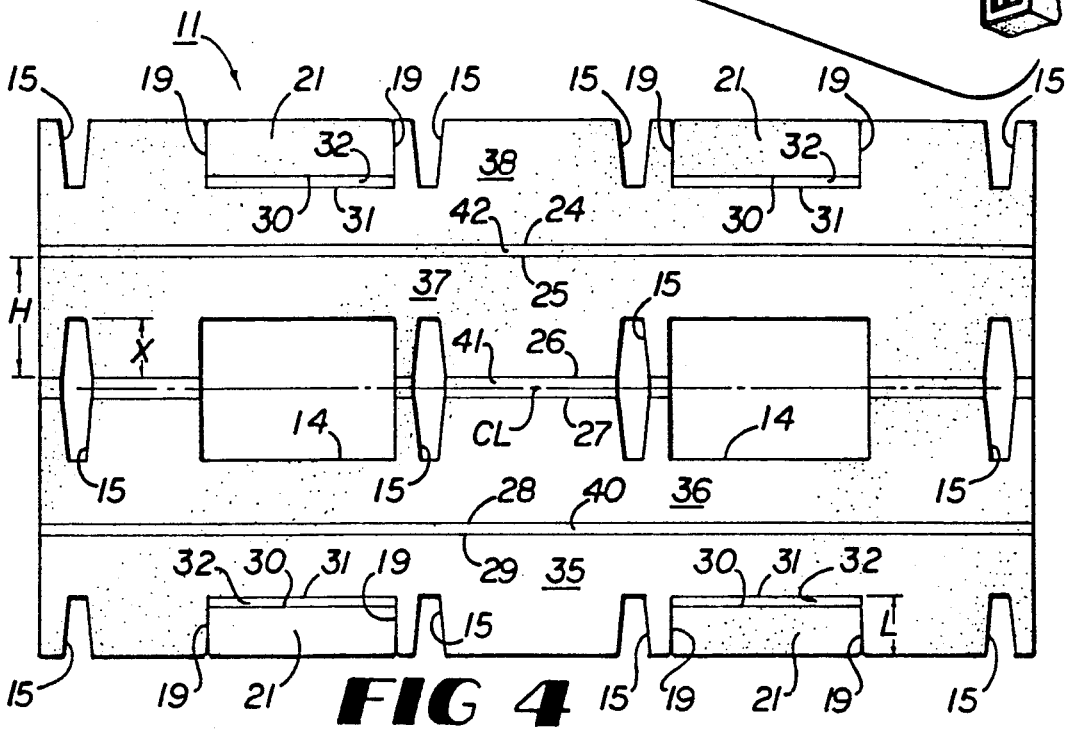
FIG. 4 is a top plan view of a cut and scored blank prior to its formation into a cross member.
Figure 5:
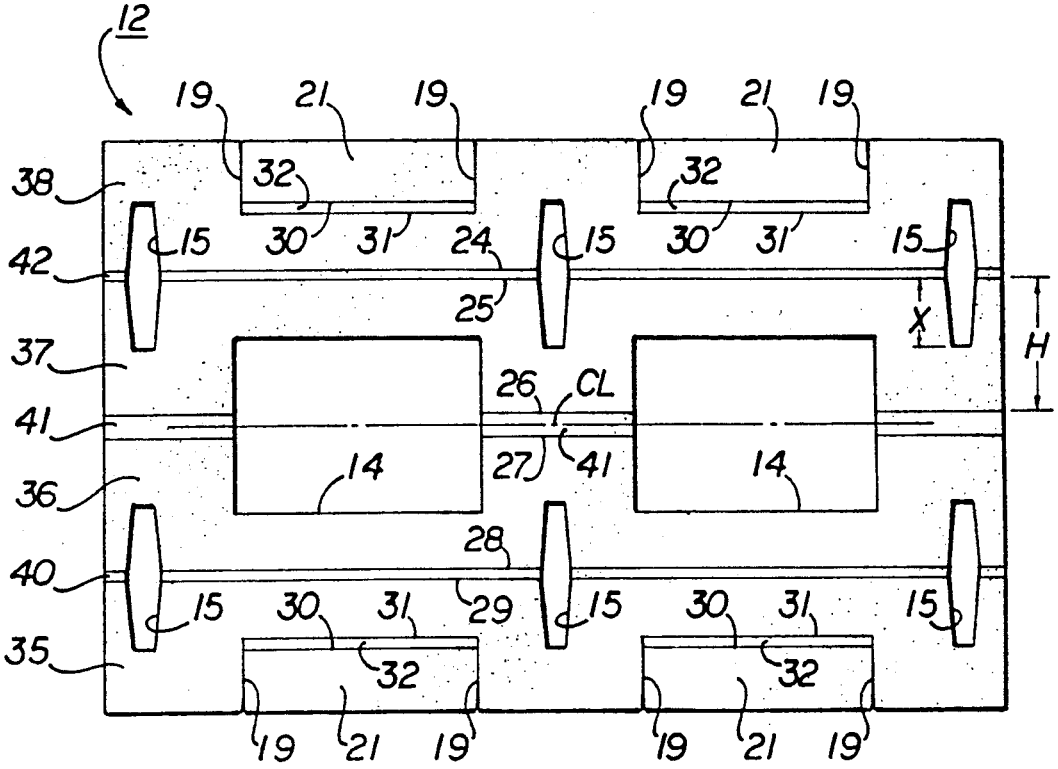
FIG. 5 is a top plan view of a cut and scored blank prior to its formation into the other cross member.

The longitudinal and lateral members are formed from rectangular corrugated paperboard blanks, although other materials such as fiberboard, plastic or the like may also be used. FIGS. 4 and 5 show a representative example of a longitudinal member 11 and lateral member 12, respectively, used in the pallet shown in FIG. 2 and as they appear prior to the folding process. As stated previously, any number of longitudinal and lateral members can be used for producing pallets of varying sizes. Typically, however, the pallets are designed to be 48"×40" to accommodate conventional conveyors, warehouse space, shipping containers, and product limitations among others. Both longitudinal member 11 and lateral member 12 are first cut, by any one of various cutting means known to those skilled in the art, to form cutouts 14, notches 15, and cut edges 19 which extend the entire width of support panels 21 as shown by arrows L in FIG. 4. Cutouts 14 are symmetrical about the longitudinal centerline (CL) of members 11 and 12 and can have varying lengths and widths. Notches 15 are positioned differently in member 11 than member 12. In member 11 (FIG. 4), the notches are located symmetrically about the centerline and along the outer edges of the member. In member 12, all the notches are located equidistant from the centerline (CL) about end panels 40 and 42. The spacing of the notches in the longitudinal direction of members 11 and 12 is varied according to the size of the pallet.

After members 11 and 12 are cut, they are then scored to create folding lines 24, 25, 26, 27, 28, 29, 30 and 31, such scoring performed by any of the various means known in the art such as a scoring roller and attendant operating means. Scoring lines 26 and 27 are broken due to the position of cutouts 14 and notches 15. It should be noted that all scoring lines are made on one side of the rectangular. The scoring lines divide the members 11 and 12 into four folding panels 35, 36, 37, and 38 and three end panels 40, 41, and 42. End panel 41 of longitudinal member 11 is divided into segments, again due to cutouts 14 and notches 15 and end panels 41 and 42 of lateral member 12 are divided due to notches 15. During the folding process, folding panel 35 is folded inward about folding lines 28 and 29 so that its inner surface lies flat against folding panel 36 and folding line 27 lines up with the outer edge of panel 35. Folding panel 38 is put through the same process so that folding line 26 lines up with the outer edge of panel 38. Then panels 35 and 36 together are folded inwardly toward panels 37 and 38 and along folding lines 26 and 27 to the point where the outer back surfaces, as shown in FIG. 4 and FIG. 5, are flush against one another.

Figure 6:
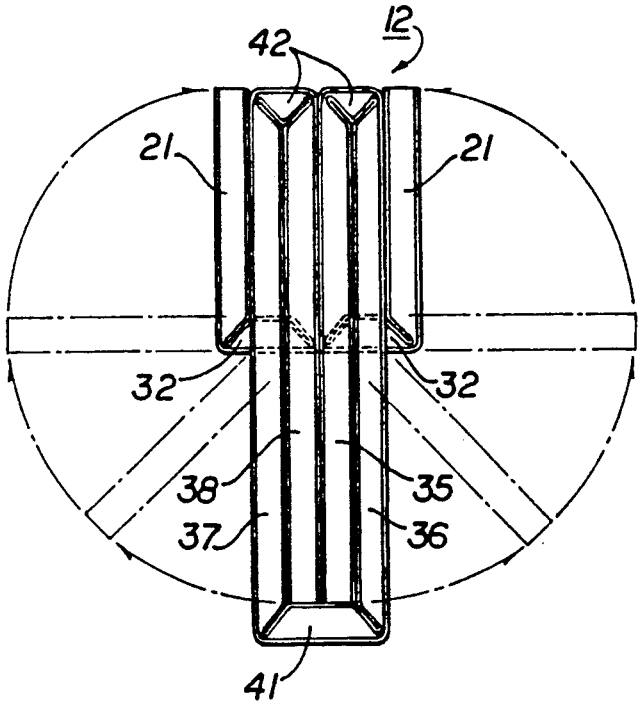
FIG. 6 is an end elevational view of one of the cross members, the phantom lines and arrows illustrating the folding of the reinforcement elements at the lifting sites.

In between these two folding operations, support panels 21 are folded downward and upward against panels 36 and 37 and are secured thereto so that support panels 21 lie flush against panels 36 and 37 (FIG. 6). As can be seen in FIGS. 1, 2 and 6, this design of the lifting points results in a structure six or twelve walls wide at the critical points where the tines of pallet lifting equipment engage the pallet. If double wall construction of the rectangular blank is used, which is the preferred construction, the support points are twelve walls in width. This added strength at the critical lifting points increases not only the load carrying capacity of the pallet, but also the durability and toughness of the pallet. This unique construction provides a lifting area comprising a completely unbroken surface, i.e. no exposed fluting which might be compressed or torn by the tines of a fork lift. In addition, the double score lines 30 and 31 which flank panel 32 reinforce and provide superior resistance to tearing or damage in the cutout areas of the blank once the blank is folded, as no raw corners are exposed. The solid panels 32 also act against all the panels in the lifting area, one half for each panel 32, as all panels are oriented in the same direction once the blank is folded. This avoids any instability in the beam or stringer, such as that which might occur with panels oriented in different directions, or in pallets where there is exposed fluting or spaces between vertical support members. In addition, by wrapping any exposed fluting in the lifting area, moisture and any other contaminants, i.e. are prevented from entering the structure, thereby ensuring sanitary conditions. The overlapped area provides lifting capabilities which allow 2000 to 3000 pounds to be lifted with minimal deflection or deformation. Tests have shown that just one set of lifting areas provides over 6000 pounds of lifting strength. Total deflection in the beams has been measured at less than $\frac{1}{4}$ inch which is equivalent to comparable wooden pallets. Structural performance can be maintained as load weights vary by simply changing the paper weight as required for the load.

The dimensions of the longitudinal and lateral members will vary depending in the size of the pallet being made. However, the width of panels 35 and 38 should be slightly less than the width of panels 36 and 37 to account for the fact that panels 35 and 38 are folded inward first and thus do not extend the entire width of the inner members. Also, end panel 41 should be wider than end panels 40 and 42 due to the fact that panel 41 extends the entire width W of the members. The depth X of notches 15 should be one half the height H of members 11 and 12, however, the dimensions for cutouts 14 and support panels 21 are adjustable to accommodate the tines of various sized pallet lifting equipment.

During the folding process for making members 11 and 12, a securing means, such as a suitable adhesive, is applied to at least one of the mating surfaces of the panels, either by spraying heads or gluing rollers or the like, to secure the respective panels in a side-by-side laminated beam configuration. The adhesive, if used, is preferably recyclable and can be dissolved in a recycling operation if necessary.

Figures 7A, 7B, 7C, 7D, 7E, 7F:
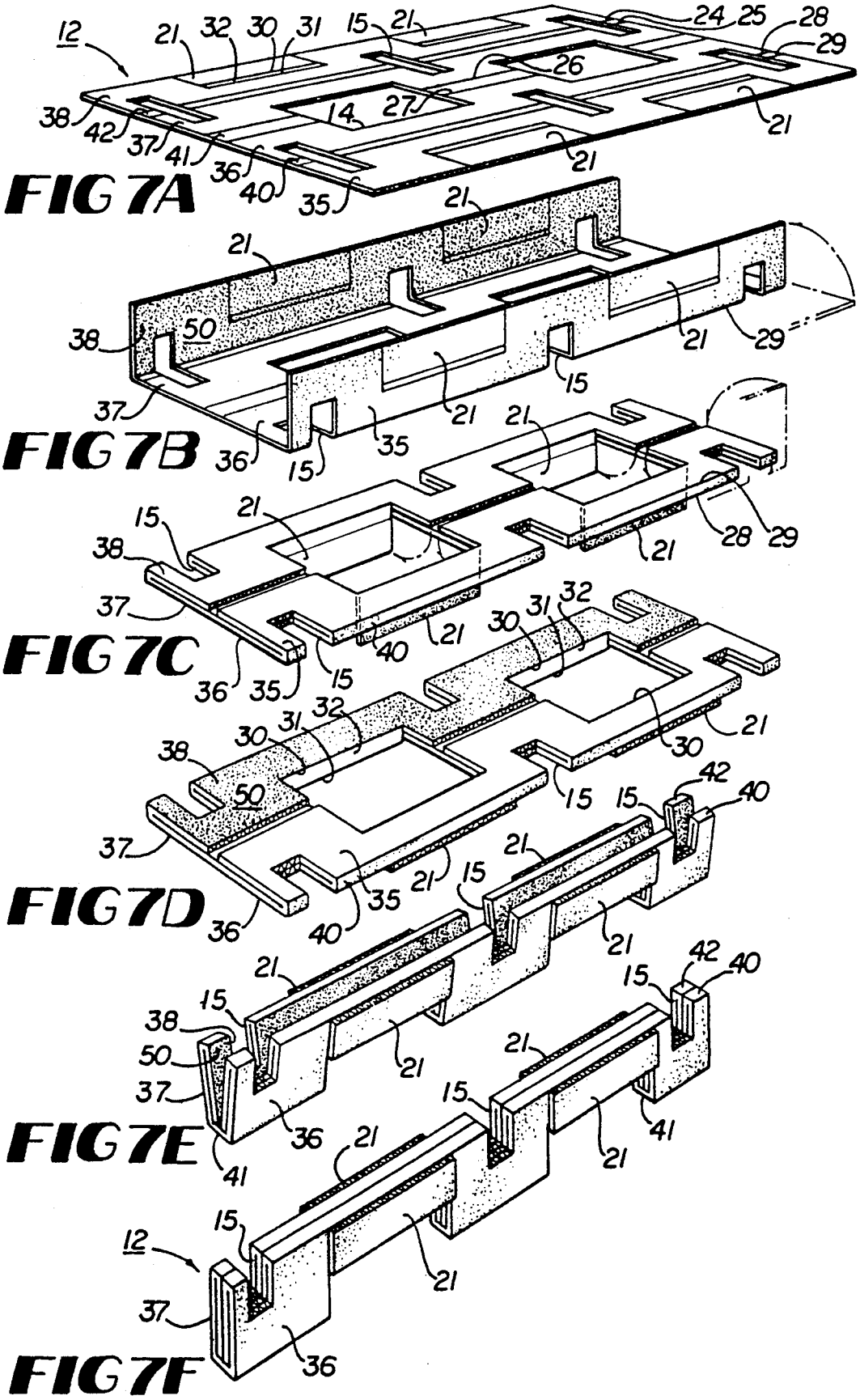
FIGS. 7A through 7F are sequential perspective views illustrating the folding sequence involved in the formation of a cross member.

FIG. 7 illustrates sequentially the folding of a stringer, in this case, stringer 12. After the blank is cut and scored for folding, a suitable securing means, such as an adhesive 50 is applied to panels 35 and 38, including portions 21. These panels are then folded inwardly, thereby marrying panel 35 to panel 36 and panel 37 to panel 38. Panels 21 are then folded upwardly against the now outwardly facing sides of panels 36 and 37 and secured thereto. Adhesive is then applied to at least one of the outwardly facing sides of panels 35 and 38 and these are then married together. The finished beam is then compressed using rollers, a press, or other suitable means as an aid in laminating the beam. The finished stringer 12 is then sent to an assembly station wherein it and other stringers 11 and 12 are assembled into the grid structure as shown in FIG. 3.

When assembly of the stringers is complete, top and/or bottom sheets are applied to the grid structure as discussed hereinabove and shown in FIGS. 1 and 2. The top sheet 13 is normally a solid rectangular panel that is adhesively bonded to the upper edges of the stringers. The top sheet may also be designed with downwardly extending sidewall portions 52 and an inwardly extending bottom portion 54, these two portions being shown in phantom lines in FIG. 1 and being utilized to "wrap" the pallet. The sidewall portions facilitate banding or shrink wrapping of various goods to be shipped on the pallet, providing a substantially flat surface for receiving the bands or wrapping material. The bottom portions 54 facilitate movement on a roller-type conveyor system as well as helping to secure the sidewall portions in place. The bottom sheet 16 is normally flat and may have cutout portions 56 to receive the rollers which support the ends of certain hand jack tines. The rollers must make contact with the warehouse floor or ground as the lifting means with such a device is a separate platform or tines which operate independently of the roller-equipped tines.

The process for assembling the pallets once the longitudinal and lateral members have been formed comprises an alignment and interconnection step wherein the lateral members are aligned in a spaced parallel relationship after which the longitudinal members are interconnected by matching corresponding notches 15 on each longitudinal and lateral member. The process for assembling the pallets also include as an option, the step of applying adhesive material to the top and/or bottom edges of the cross members and applying a top and/or bottom sheet of corrugated paperboard to the edges of the cross members.

Thus, while a pallet and a method for constructing the pallet, and variations thereof, have been shown and described in detail herein, various additional changes and modifications may be made without departing from the scope of the present invention.

I claim:

1. A pallet of corrugated material comprising:

a plurality of spaced, parallel and longitudinally extending stringers;

a plurality of spaced, parallel and laterally extending stringers interconnecting said longitudinally extending stringers at spaced intervals;

the stringers of at least one of said pluralities of longitudinally and laterally extending stringers including cutouts therein to provide fork lift tine channels axially aligned therewith for lifting said pallet;

said stringers which include cutouts including an uncut surface of corrugated material defining the lifting surface against which the tines inserted in said cutouts can act for lifting said pallet;

wherein said longitudinally extending stringers and laterally extending stringers comprise a plurality of inner adjacent vertical panels each connected to an adjacent top horizontal panel, said top horizontal panels connected to an adjacent outer vertical panel, said outer panels each being disposed adjacent an inner vertical panel, with said outer vertical panels connected to a common bottom horizontal panel; and wherein said cutouts are formed by removing portions from said outer vertical panels and folding portions from said inner vertical panels through said removed portions of said outer vertical panels for forming a solid surface upon which the fork lift tines can act for lifting said pallet.

2. A pallet as defined in claim 1 wherein each longitudinally and laterally extending stringer is formed from a single sheet of corrugated material.

3. A pallet as defined in claim 1 in which each of said folding portions include a vertical portion secured to a respective outer vertical panel.

4. A pallet as defined in claim 3 in which each of said folding portions also include a horizontal portion for forming said lifting surface.

5. A pallet as defined in claim 1 in which both of said longitudinal and lateral stringers include cutouts therein for providing fork lift tine channels in each of the sets of stringers.

6. A pallet of corrugated material for use in storing and shipping goods disposed thereon, said pallet comprising a plurality of horizontally oriented stringers assembled into a grid structure, said grid structure including a plurality of spaced, parallel, laterally extending stringers interconnected with a plurality of spaced, parallel longitudinally ext ending stringers, said stringers including a plurality of vertically oriented panels laminated together, with at least one of said pluralities of laterally extending stringers or said longitudinally extending stringers having cutout portions for receiving the tines of a fork lift or the like to lift said pallet, said cutout portions including outer vertically oriented panels and inner vertically oriented panels and a lifting surface disposed perpendicular to said vertically oriented panels and wherein said cutouts are formed by removing portions from said outer vertical panels and folding portions of said inner vertical panels through said removed portions of said outer vertical panels to form said solid lift solid surface against which the fork lift tines can act for lifting said pallet.

7. A pallet as defined in claim 6 wherein said longitudinally extending stringers and laterally extending stringers comprise said inner adjacent vertical panels each connected to an adjacent top horizontal panel, said top horizontal panels each connected to an adjacent outer vertical panel, with said outer vertical panels connected to a common bottom horizontal panel except at said cutout portion.

8. A pallet as defined in claim 6 wherein each longitudinally and laterally extending stringer is formed from a single sheet of corrugated material.

9. A pallet as defined in claim 6 in which each of said folding portions include a vertical portion secured to a respective outer vertical panel.

10. A pallet as defined in claim 6 in which both of said longitudinal and lateral stringers include cutouts therein for providing fork lift tine channels in each of the sets of stringers.

11. A pallet of corrugated material for use in storing and shipping goods disposed thereon, said pallet comprising a plurality of horizontally oriented stringers assembled into a grid structure, said grid structure including a plurality of spaced, parallel, laterally extending stringers interconnected with a plurality of spaced, parallel longitudinally extending stringers, said stringers including a plurality of vertically oriented panels including outer and inner vertical panels laminated together, with at least one of said pluralities of laterally extending stringers or said longitudinally extending stringers having cutout portions for receiving the tines of a fork lift or the like to lift said pallet, said cutout portions including a lifting surface disposed perpendicular to said vertically oriented panels, said cutouts being formed by removing portions from said outer vertical panels and folding portions from said inner vertical panels through said removed portions of said outer vertical panels for forming a solid surface against which the fork lift tines can act for lifting said pallet.

12. A pallet for use in storing and shipping goods disposed thereon, said pallet comprising a plurality of horizontally oriented stringers assembled into a grid structure, said grid structure including a plurality of spaced, parallel, laterally extending stringers interconnected with a plurality of spaced, parallel, longitudinally extending stringers, with at least one of said pluralities of laterally or longitudinally extending stringers having cutout portions for receiving the tines of a fork lift or the like to lift said pallet, said stringers each including a plurality of vertically disposed, laminated panels and being formed by folding a sheet of material having a central section flanked by right and left side sections, said central section having portions removed therefrom and said side sections folding panel portions which are folded through said portions removed from said central section when said sections are folded to form one of said stringers and which folding panel portions are disposed perpendicular to said vertically disposed laminated panels of said one stringer to form a solid surface against which the fork lift tines can act for lifting said pallet.

13. A method of forming elongated corrugated paperboard stringers for use in forming a pallet having a plurality of said stringers arranged in a grid structure, with each stringer formed from a single blank of corrugated paperboard said method comprising the steps of:

a) cutting out generally rectangular portions from the central portion of said blank, the cutout portion extending equally from each side of the longitudinal centerline of said blank and being equally spaced from the lateral centerline thereof;

b) cutting out generally elongated rectangular portions from said blank, said elongated cutout portions being formed on each side of said cutouts formed in step a and being spaced equally therefrom;

c) cutting slots which extend inwardly from the longitudinal edges of said blank, said slots being spaced apart and in substantial axial alignment with the lateral edges of said cutouts formed in step a;

d) scoring said blank on one side thereof on each side of the longitudinal centerline thereof and equidistant therefrom, in two additional places so as to dissect said elongated notches formed in step b, and in four additional places, the scoring extending between and connecting said slots of step c, thereby forming four longitudinally extending panels, two outer panels and two inner panels;

e) folding said outer panels inwardly and securing each of said outer panels to a respective inner panel;

f) folding the portions defined by said slots against said outer panels and securing said portions thereto; and g) folding the secured outer and inner panels together and fastening said panels together to form said stringer.

* * * * *